US007717276B2

(12) United States Patent
Alves

(10) Patent No.: US 7,717,276 B2
(45) Date of Patent: May 18, 2010

(54) STAND FOR DISPLAYING ARTICLES, SUCH AS FLAT-PACKED ARTICLES

(75) Inventor: Manuel Alves, Tortosendo (PT)

(73) Assignee: Joalpe Industria De Expositores, S.A., Tortosendo (PT)

( * ) Notice: Subject to any disclaimer, the term of this patent is extended or adjusted under 35 U.S.C. 154(b) by 840 days.

(21) Appl. No.: 10/573,269

(22) PCT Filed: Sep. 8, 2004

(86) PCT No.: PCT/EP2004/014083

§ 371 (c)(1),
(2), (4) Date: Aug. 22, 2006

(87) PCT Pub. No.: WO2005/030012

PCT Pub. Date: Apr. 7, 2005

(65) Prior Publication Data

US 2007/0080122 A1 Apr. 12, 2007

(30) Foreign Application Priority Data

Sep. 8, 2003 (FR) ..... 03 10564

(51) Int. Cl.
*A47F 7/00* (2006.01)

(52) U.S. Cl. ..... 211/59.2

(58) Field of Classification Search ..... 211/59.2, 211/126.1, 11, 59.3, 184, 188, 43; D6/462; D7/631

See application file for complete search history.

(56) References Cited

U.S. PATENT DOCUMENTS 438,713 A * 10/1890 Petersen ..... 211/43
1,460,642 A * 7/1923 Cadenhead ..... 211/43
1,725,702 A * 8/1929 Cubberley ..... 211/184
1,750,575 A * 3/1930 Cubberley ..... 211/11
1,750,576 A * 3/1930 Cubberley ..... 211/11
1,772,438 A * 8/1930 Cubberley ..... 211/11
2,419,721 A * 4/1947 Kopp ..... 248/456
3,063,567 A * 11/1962 Campbell ..... 211/43
3,385,450 A * 5/1968 Nadler et al. ..... 211/42
3,487,945 A * 1/1970 Barham ..... 211/43
3,844,415 A * 10/1974 Heimann ..... 211/43
4,343,450 A * 8/1982 Anderson ..... 248/454
4,458,874 A * 7/1984 Rabas et al. ..... 248/670
4,496,127 A * 1/1985 Nelson ..... 248/441.1
4,512,480 A * 4/1985 Evenson ..... 211/11
4,560,073 A * 12/1985 King ..... 211/184
4,856,658 A * 8/1989 Novak ..... 211/26.1
4,874,099 A * 10/1989 Arnott et al. ..... 211/50

(Continued)

FOREIGN PATENT DOCUMENTS

DE 32 11 880 10/1983

(Continued)

*Primary Examiner*—Sarah Purol
(74) *Attorney, Agent, or Firm*—Egbert Law Offices PLLC

(57) ABSTRACT

The invention relates to a display stand including a backrest which can slide along a rail by a manually-actuated tab so as to form an adjustable area for displaying articles. The invention is characterized in that the stand also includes an independent backstop device which operates by co-operation between at least one notched extension located at the sliding backrest and at least one complementary toothed counterpart positioned on the rail supporting the backrest.

2 Claims, 5 Drawing Sheets

U.S. PATENT DOCUMENTS

| | | | | |
|---|---|---|---|---|
| 4,897,958 | A * | 2/1990 | Brydges | 47/68 |
| 5,411,146 | A * | 5/1995 | Jarecki et al. | 211/59.2 |
| 5,749,475 | A * | 5/1998 | Krebs | 211/24 |
| 6,053,338 | A * | 4/2000 | Avery et al. | 211/65 |
| 6,352,162 | B1 * | 3/2002 | Yang et al. | 211/43 |
| 6,446,802 | B1 * | 9/2002 | Lutz et al. | 206/354 |
| 6,497,326 | B1 * | 12/2002 | Osawa | 211/59.2 |
| 6,823,997 | B2 * | 11/2004 | Linden et al. | 211/59.3 |
| 7,168,579 | B2 * | 1/2007 | Richter et al. | 211/59.3 |
| 7,458,473 | B1 * | 12/2008 | Mason | 211/59.3 |
| 2002/0170866 | A1 * | 11/2002 | Johnson et al. | 211/59.3 |
| 2003/0150829 | A1 | 8/2003 | Linden et al. | |
| 2005/0092703 | A1 * | 5/2005 | Mueller et al. | 211/59.3 |
| 2007/0080122 | A1 * | 4/2007 | Alves | 211/59.2 |

FOREIGN PATENT DOCUMENTS

| | | |
|---|---|---|
| WO | WO 00/48488 | 8/2000 |

* cited by examiner

STAND FOR DISPLAYING ARTICLES, SUCH AS FLAT-PACKED ARTICLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to an article display rack, notably flat-packed articles, which may be arranged on the edge thereof, such as for example for foodstuffs or various blister-packed products.

BACKGROUND OF THE INVENTION

The arrangement of the articles on the selling premises in the form of a stack of packages is hardly attractive to customers, such unstable constructions lead to rapid dissemination of the packages throughout the shelf spaces with a mixture of the different articles. An arrangement of the packages on the edges thereof and without a particular display rack brings about the same shortcomings.

The presentation of the articles on the selling premises and notably in the shelf spaces in the supermarket, has involved for some time more and more sophisticated means to meet the customers' expectations. The customers expect easy access and rapid visualization of the product which they are looking for and that, regardless of the height of the shelves, it is therefore particularly important that the arrangement of the articles in the department should enable to expose the visual items printed on the packaging. From a management viewpoint of the selling premises, it is moreover desirable to improve the display efficiency of the articles on the racks, to limit the arrangement time or the replacement time, and to do so, display racks which are more functional than simple shelves are necessary.

To solve the shortcomings associated with stacked articles, different devices have been suggested for more advantageous and more functional presentation in the shelf spaces. Entirely automatic display racks enabling the articles to move forward towards the customers as they are taken off the racks may be realized, but the high costs of such racks limit the use thereof to automatic dispensers such as those delivering beverage cans or sweets, in public places notably.

There are also semi-automatic devices which use a push-type system with a rail-mounted recall spring, which system comprises a set of mechanically fragile parts for an intensive use and is moreover relatively costly to manufacture.

In supermarkets, the large number of shelves to be equipped, and the fact that customers help themselves induces the necessity of highly heavy-duty racks, quite reliable functionally and of very low costs. To remedy certain shortcomings, various devices have been suggested for edge-standing articles, using a rack moving over a toothed rail. However, this system does not enable to solve an essential operating problem of such type of display rack for edge-standing articles, which consists in preventing the articles from returning to the rear of the bracket, acting as a support, under the effect of the weight of the articles or careless handling of the customers when grabbing said articles.

When the display rack has been loaded with articles over the whole length thereof by the staff of the store, the customers seize the first elements exhibited, then as the rail becomes empty, it is necessary to bring the rear support forward for easier access to the commodities. Still, failing any anti-recall system, the mobile support returns rapidly backwards during usage and the articles become again hardly accessible to the customers.

To attempt at solving this problem, different solutions have been suggested, with a ladder bracket assembly whereas both parts co-operate, or different rail-mounted devices. However, these presentation assemblies are complex, comprise parts whereof the manufacture is delicate and which prove brittle when using.

The purpose of the invention consists then in solving the main difficulties encountered by the display racks for edge-standing articles, intended for sales and in direct contact with the consumers on the selling premises, i.e. the provision of a display rack of minimum costs, heavy-duty, designed for daily usage and round the year on the selling point, with as simple as possible an operation and with an efficient anti-recall function.

BRIEF SUMMARY OF THE INVENTION

According to the invention, the, difficulties listed previously can be solved with a display rack for articles comprising a back rest capable of sliding on a rail, in particular using a pull strip actuated manually capable of forming an adjustable area for displaying said edge-standing articles. Which display rack is characterized in that it exhibits moreover an independent anti-recall device co-operating at least between an indexed extension piece placed at the sliding back rest and at least one complementary toothed counterpart positioned on the support rail of said backrest.

According to the invention, and in relation to the previous art, the main advantages of the display rack are the low manufacturing costs of the moulded plastic parts and the operating efficiency, in particular as regards the anti-recall function. Simplicity, functionality and robustness of the display rack authorize intensive use such as required for use in the shelf spaces of department stores.

Other characteristics and advantages of the invention will appear using the following description in combination with the appended drawings, given solely for non-limiting exemplification purposes.

DETAILED DESCRIPTION OF THE INVENTION

Figure 1:
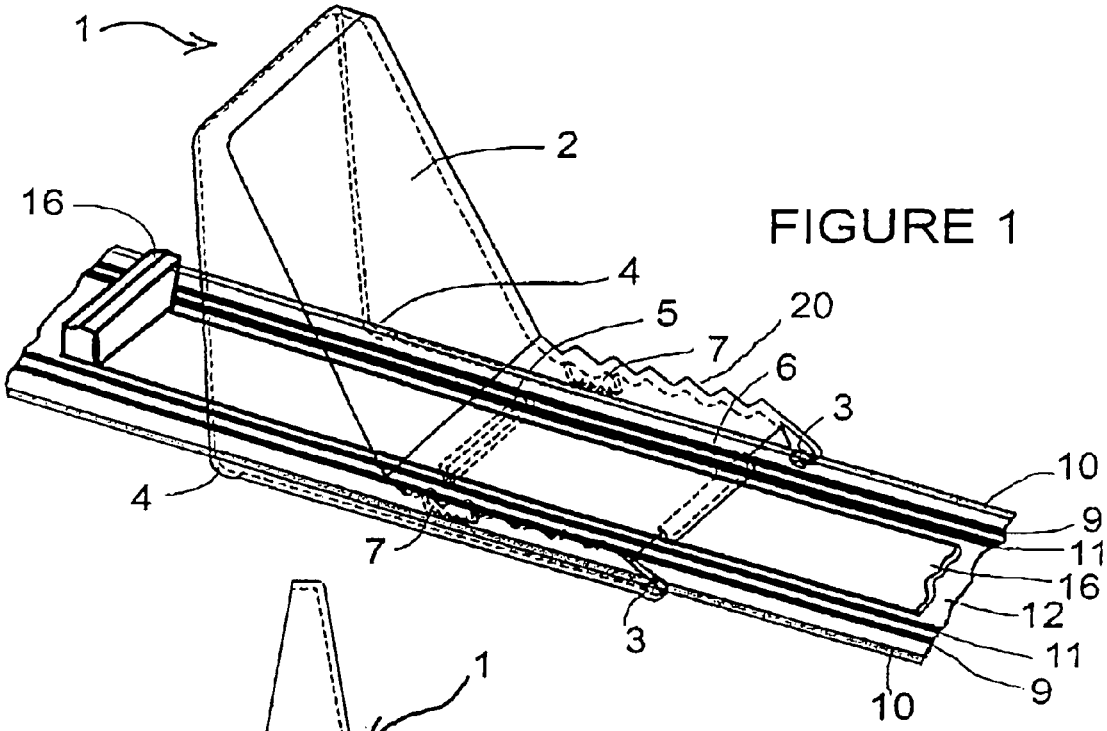
FIG. 1 is a three-quarter perspective front view of the back rest of the display rack exhibiting the back rest, the fait and the pull strip, according to the invention.

The invention concerns a display rack of articles, comprising a back rest 1 capable of sliding on a rail 8, in particular using a pull strip 16 actuated manually, capable of forming an adjustable area for displaying said edge-standing articles.

According to the invention and with reference to the different Figures, the back rest 1 is capable of moving on the rail 8 in the single direction towards the front of the shelves, i.e., towards the customer, by manual traction by means of the pull strip 16 integrated to the device.

The display assembly comprises at least the three following elements:

- the rail 8 intended for receiving the edge-standing articles, exhibiting a surface formed by wide pleats so that said article(s) may be placed therein, on which rail the back rest 1 moves in particular;
- the back rest 1 acting as a rear support for the articles placed on the rail 8 and also having a surface formed of wide pleats so that one or several articles may be placed therein; and
- the sliding pull strip 16, integrated to the rail 8, enabling to move the back rest 1 forward as the articles placed directly accessible to the buyers are taken off the shelves.

Said pleated surfaces of the rail and of the back rest form notably the laying plane of said articles to be offered on the edge thereof. More precisely and as shown on FIGS. t and 2, the back rest 1 is shaped in a particular fashion for ensuring maintenance of the articles offered in a position close to the vertical by means of a serrated pleated surface 20, with isosceles or equilateral teeth placed on the top of the front portion of the part; thus, the articles may bear against one another and against the supporting back 2 of the back rest without slipping.

The back rest 1 is an essential portion of the display rack. Its shape enables it to move on the rail 8, illustrated on FIGS. 3 to 6, by means of the pull strip 16, which pull strip 16, actuated manually, rests therefore on the rear stop 5 positioned substantially in the middle of the lower section of the back rest.

The front section of the back rest also comprises a front stop 6 intended for blocking the progress of the back rest on the rail in its extreme position by means of stops placed on the edges of the rail and not represented on the Figures.

The back rest 1 is also fitted in its front section with two toes 3, resting laterally under the rail 8, to act as guides and maintenance for the assembly to slide on the rail when the pull strip 16 is actuated. In the rear section of the back rest, in 4, the part is shaped to providing a mechanical reinforcement also forming a support so that the positioning and the loading operations of the display rack may be carried out numerous times without breaking.

The back rest 1 is advantageously a plastic molded part. However, other materials may be contemplated without departing from the framework of the invention.

The display rack for articles exhibits moreover an independent anti~recall device operating by co-operation between at least an indexed extension piece 7 placed at the sliding back rest 1 and at least one complementary toothed counterpart to positioned on the support rail 8 of said back rest.

More precisely, the back rest 1 comprises on its lower internal side face and substantially in the center of the resting plane two indexed extension pieces 7 shaped so as to ensure anti-recall function and to enable the displacement of the back rest towards the front of the shelves. More precisely, as illustrated on FIGS. 2 and 5, both indexed extension pieces 7 include a restricted number of notches.

Figure 5:
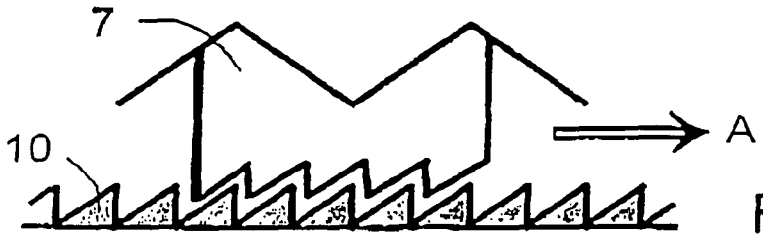
FIG. 5 is a partial side view of the rail illustrating the co-operation between the indexed extension pieces and the complementary toothed counterparts in the running direction A of the sliding back rest, according to the invention.

Geometrically, these notches correspond to a succession of rectangular triangles whereof the hypotenuse determines the possible displacement direction for the back rest, as illustrated on FIG. 5. In a displacement direction, the teeth slide over one another, whereas in the reverse direction, the teeth abut against one another. Both indexed extension pieces 7 are shaped as additional thicknesses of the internal side faces and under the lower face of the back rest by means of a mold of suitable manufacture. The stiffness of this portion then being maximal so as to resist the usage loads.

Figure 3:
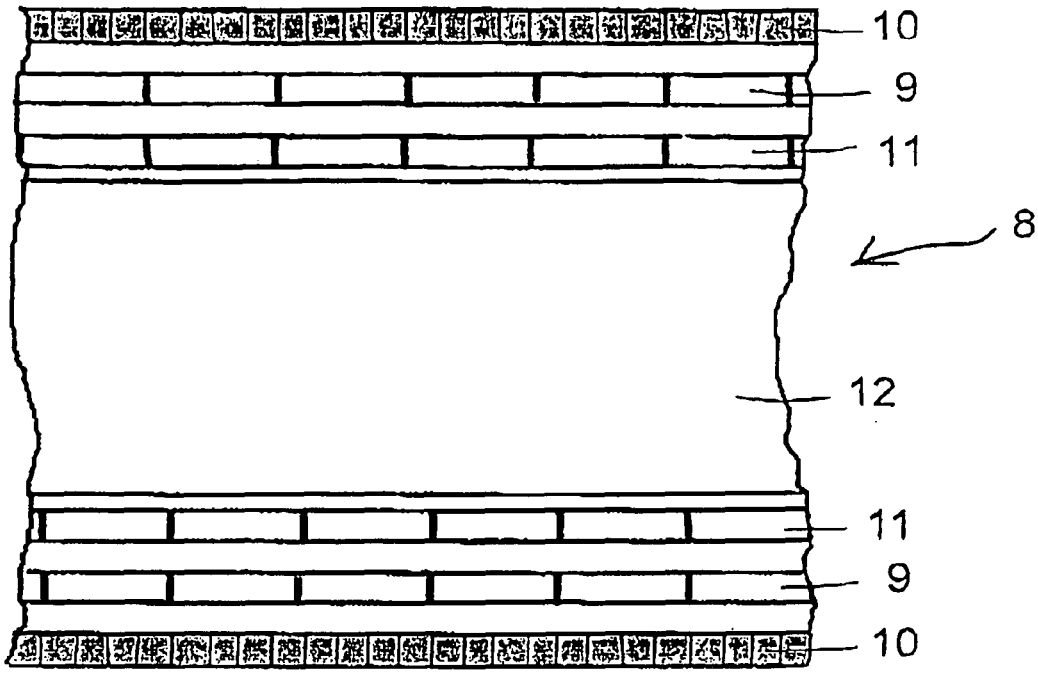
FIG. 3 is a partial top view of the rail of the display rack, according to the invention.

As shown on FIG. 3, a partial view from beneath the rail 8 is broken down into two external side zones, each supporting the complementary toothed counterparts 10 of the indexed extension pieces 7, as well as two rows of wide identical pleats for supporting the edge-standing products, in a serrated pattern isosceles or equilateral, 9 to the outside of the rail and 11 more inwardly, and finally an internal zone 12 ensuring the link between both rails and supporting the pull strip 16.

Figure 4:
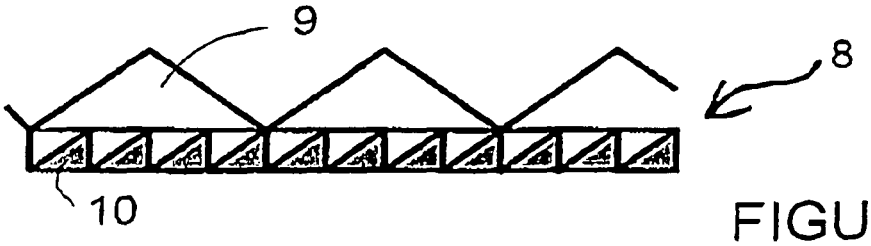
FIG. 4 is a side view of the rail, illustrated on FIG. 3.

More precisely, FIG. 4 illustrates a partial side view of the rail 8 which shows the serrated support 9 and the complementary toothed counterpart 10 of the indexed extension piece 7. Which saw teeth 9 are intended for receiving the edge-standing articles, in a position close to the vertical, at the front of the sliding back rest.

Besides, the rear 5 and front 6 stops take part in the guiding of the back rest 1 on the rail 8 which defines a longitudinal groove at said internal zone 12.

FIG. 5 represents said indexed extension piece 7 with the complementary toothed counterpart 10 and the possible direction of displacement A of the back rest.

It should he noted that the pleated serrated zones 9, 11 of the rail 8 and the pleated serrated zone 20 of the back rest 1 have sizes corresponding to the articles to be exhibited standing on their edges, whereas the toothed extension piece 7 and its counterpart 10 have smaller teeth for accurate displacement of the back rest 1 on the rail 8 and also promote the anti-recall function. It is thanks to the physical separation of the serrated racks that such an operation is made possible and more stable, which makes the anti-recall device independent, notably from the configuration of the laying arrangement of the edge-standing articles.

Figure 6:
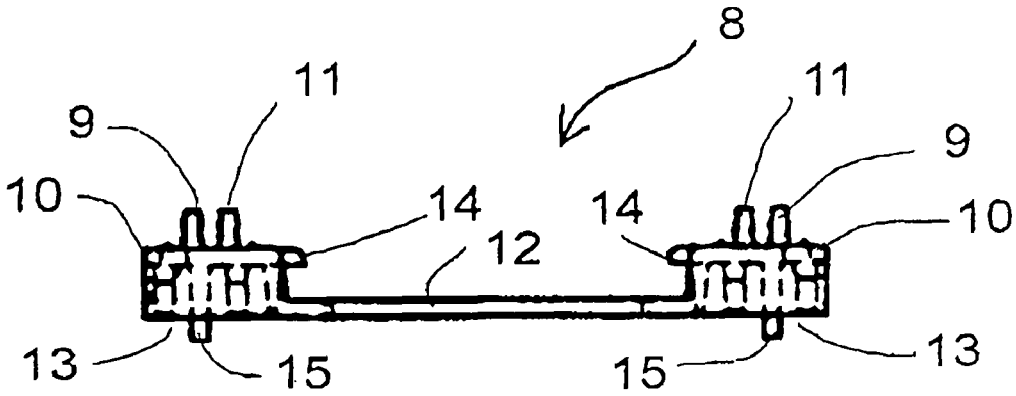
FIG. 6 is a sectional view of the support rail, illustrated on FIG. 3.

The sectional view of the rail 8 of FIG. 6 enables to understand the relative arrangement of the different elements. On this diagram, the serrated supports 9 and 11 are visible from the front. Both toothed counterparts 10 are placed outside the rail and this illustration includes two longitudinal supports 15 of the rail intended to be in contact with the shelves. Said supports delineate sliding zones 13 with the external edge of the rail.

The internal linking zone 12 leaves a free space between both lateral zones for the pull strip 16 to slide, which pull strip is maintained against the upper face of the linking zone 12 by means of the profiles 14, which profiles may be reduced to simple toes situated at the front of the rail 8. The profiles 14 prevent the user, in case of incorrect operation, from lifting the pull strip 16 outside the internal zone 12 and from causing therefore the articles to drop. The pull strip exhibits a boss 23 on its upper face for easier actuation.

Moreover, when not in use, said pull strip 16 is retracted completely into the linking zone 12 of the rail, without protruding from the front thereof. In such a position, said boss 23 rests against said profiles 14 and the pull strip is maintained by a pressure system. Said pressure system may notably be in the form of at least one knob 21 situated on the lower surface of the pull strip, co-operating with a hole in the linking zone 12 or still with a rim situated at the front of a shelve system, which rim protruding from a window into the internal zone 12, According to the operating mode offered by the invention, the back rest is positioned on the rail 8 by two toes 3 engaging into two recesses, not illustrated, provided at the back of the rail in the lateral portions, which recesses enable the toes 3 to access the sliding zones 13. Once the front section of the back rest is engaged far enough into the rail, the rear section 4 of the back rest is snapped in position by pressing downward. The rail is then sandwiched between the toes 3 and the indexed extension pieces 7.

In this so-called locked position, the indexed extension pieces 7 are in narrow contact with the complementary counterparts 10 and the back rest cannot move rearwards any longer, thanks to the rectangle triangular shape of the notches. Similarly, the action of the pull strip 16 placed at the fear of the back rest enables, while bearing upon the rear stop 5 to move the back rest forward along the rail.

The sliding of the toes 3 in the sliding zones 13 enables to guide the back rest along the rail. The weight of the articles on the back rest engages, after each tooth hopping, the indexed extension pieces 7 into the toothed counterparts 10 as the back rest moves forward on the rail. The pull strip 16 enables to move the articles forward up to the maximum point when the front stop reaches the end of the rail.

The return of the back rest towards the rear of the shelf system, for refurbishing the display rack with articles, is performed by lifting the rear section 4, then tilting the back rest forward by means of the profiles 14, which profiles may be reduced to simple toes situated at the front of the rail 8. The profiles 14 prevent the user, in case of incorrect operation, from lifting the pull strip 16 outside the internal zone 12 and from causing therefore the articles to drop. The pull strip exhibits a boss 23 on its upper face for easier actuation.

Moreover, when not in use, said pull strip 16 is retracted completely into the linking zone 12 of the rail, without protruding from the front thereof. In such a position, said boss 23 rests against said profiles 14 and the pull strip is maintained by a pressure system. Said pressure system may notably be in the form of at least one knob 21 situated on the lower surface of the pull strip, co-operating with a hole in the linking zone 12 or still with a rim situated at the front of a shelf system, which rim protruding from a window into the internal zone 12.

According to the operating mode offered by the invention, the back rest is positioned on the rail 8 by two toes 3 engaging into two recesses, not illustrated, provided at the back of the rail in the lateral portions, which recesses enable the toes 3 to access the sliding zones 13. Once the front section of the back rest is engaged far enough into the rail, the rear section 4 of the back rest is snapped in position by pressing downward. The rail is then sandwiched between the toes 3 and the indexed extension pieces 7.

In this so-called locked position, the indexed extension pieces 7 are in narrow contact with the complementary counterparts 10 and the back rest cannot move rearwards any longer, thanks to the rectangle triangular shape of the notches. Similarly, the action of the pull strip 16 placed at the rear of the back rest enables, while bearing upon the rear stop 5, to move the back rest forward along the rail.

The sliding of the toes 3 in the sliding zones 13 enables guiding the back rest along the rail. The weight of the articles on the back rest engages, after each tooth hopping, the indexed extension pieces 7 into the toothed counterparts 10 as the back rest moves forward on the rail. The pull strip 16 enables to move the articles forward up to the maximum point when the front stop reaches the end of the rail.

The return of the back rest towards the rear of the shelf system, for refurbishing the display rack with articles, is performed by lifting the rear section 4, then tilting the back rest forward to disengage the indexed extension pieces 7 of the toothed counterparts 10 attached to the rail.

Pushing the back rest rearwards enables to bring the back rest to its starting point. At the end of its stroke, the back rest is locked on the rail by engaging the section 4, the articles are arranged on the back rest and saw teeth 9 and 11 of the rail for a new cycle of usage.

In an advantageous embodiment, the article display rack has semi-automatic recall means 30, 31, 33, 34, 35 of the back rest 1 towards the rear of the rail 8 which enable an operator to move the back rest 1 to the far end of the shelf system solely by means of the pull strip.

Advantageously, the display rack has means 31, 33 for locking the anti-recall device 7, 10 of the back rest 1, when the latter reaches the end of its stroke at the front of the rail 8.

The rail 8 may notably have front stop means 33 capable of causing, at the end of a stroke and when the pull strip has been pulled forward, the back rest 1 to tilt into a disengaging position where said indexed extension pieces 7 do not co-operate any longer with the complementary counterparts of the rail 8.

Figure 9:
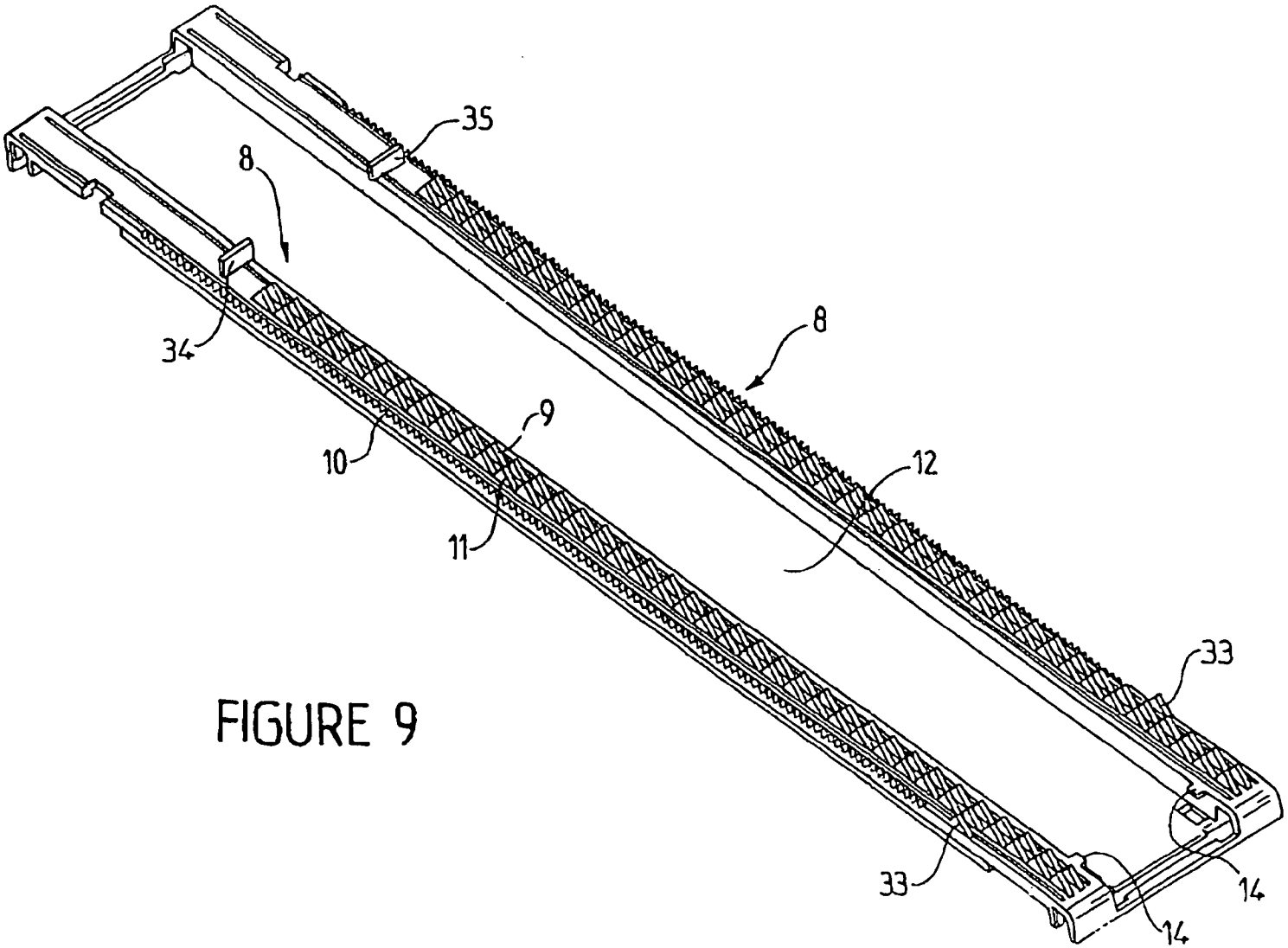
FIG. 9 is a perspective view of a rail according to a second embodiment.

As illustrated on FIG. 9, the front stop means are formed by two protrusions 33, notably triangular and capable of co-operating at the end of a stroke with two protrusions 31 on the lower section of the back rest. When the pull strip is pulled forward, the protrusions 31, 33 in contact form a ramp to force the back rest 1 to tilt forward.

Consequently, when the back rest is tilting, the pull strip 16 is capable of breaking free from the rear stop 5 to maintain the back rest 1 stably in the disengaging position.

Advantageously, the pull strip is locked in this stable disengaging position by a second stop 30 positioned on the lower section of the back rest 1. From then on, the pull strip is capable, once retracted into the rail of protruding from the other side of the rear stop 5. An operator may then move the back rest 1 towards the rear of the shelf system using the pull strip 16.

The rail 8 then shows rear stop means 34 capable of causing at the end of the stroke and once the pull strip has been retracted inside said rail 8, the back rest 1 to tilt from said disengaging position to its normal configuration of use where said indexed extension pieces 7 co-operate with the complementary counterparts 10.

Figure 8:
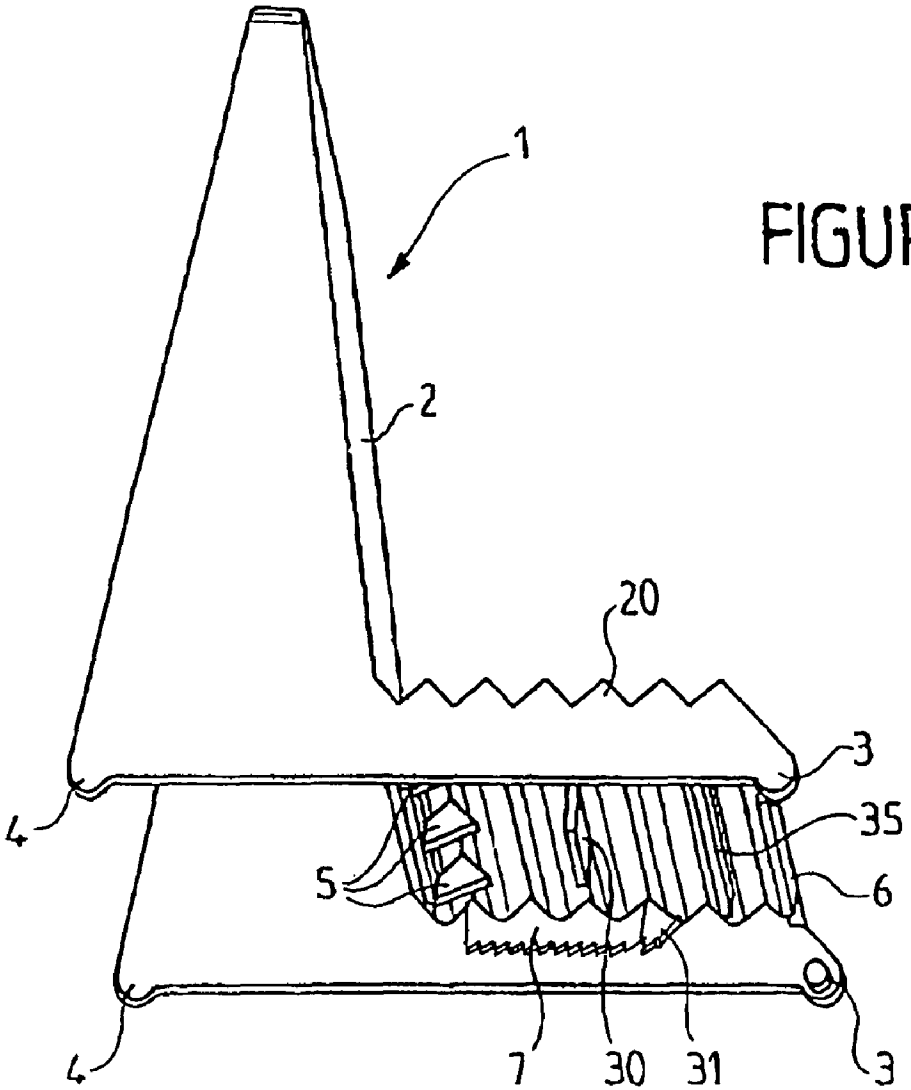
FIG. 8 is a perspective view of a back rest according to a second embodiment.

As illustrated on FIG. 9, the rear stop means are formed by protrusions 34 at the rear of the rail. These protrusions 34 of the rail are capable of co-operating with a wide protrusion 35 arranged, as illustrated on FIG. 8, on the lower section of the back rest 1.

Thus, when the protrusions 34 and 35 come into contact, the back rest 1 is locked and the pull strip is capable of clearing the stop 5 to cause the back rest 1 to tilt into configuration of use. The display rack is then ready for new usage and may then be re-garnished.

According to an advantageous non-limiting embodiment of the invention, a display rack as described on FIGS. 1 to 7, possesses the following elements.

A rail 8 of length 380 mm and of maximum width 56 mm including an intermediate linking zone 12 between both side sections of 32 mm. As illustrated on FIG. 6, each of the side sections is 12 mm wide and comprises a 1 mm-wide toothed counterpart 10 and the 1 mm-wide saw teeth 9 and 11 intended for supporting the articles for sale along the rail, which saw teeth 9 and 11, represented on FIG. 4 as a side view, are isosceles triangles 3 mm high and with a 7 mm base. In that example, the teeth carried by the toothed counterpart 10 illustrated on FIGS. 4 and 5 are rectangular triangles whereof the vertical position fulfilling the anti-recall function is 1 mm.

Figure 2:
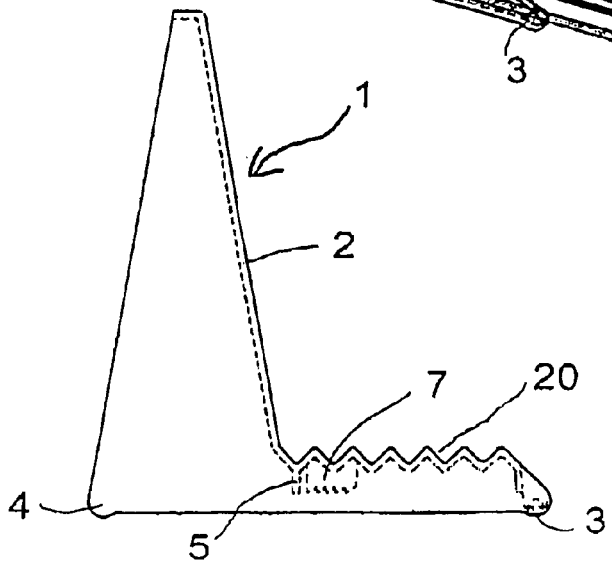
FIG. 2 is a side view of the back rest illustrated on FIG. 1.

A back rest 1 whereof the length in contact with the rail is 125 mm and the height of the supporting back is 132 mm. The width of the back rest is 60 mm so as to clamp the rail 8. i.e. sufficient width so that flat-packed articles, such as for instance delicatessen slices, may be arranged on the edge thereof without any difficulties and without any risks of tilting on either side of the rail. The rear stop 5 and the front stop 6 are identical parallelepipeda 32 mm in width, 6 mm in height and 2 mm in thickness, attached to the lower section of the back rest, as represented on FIGS. 1 and 2. The toes 3 are small cylinders 3 mm in diameter and 2 mm in height, fixed to the front and inner section of the part forming the back rest. Which toes are intended for maintaining the back rest in the slide 13 as the back rest moves forward under the action of the pull strip bearing against the rear stop 5. In such an example, the indexed extension pieces 7, as illustrated on FIGS. 1 and 2, are formed by two elements as additional thicknesses with respect to the internal side faces arranged under the lower and substantially middle section of the back rest, which extension pieces each comprise 5 teeth of identical and complementary dimensions to those carried by the toothed counterparts 10 described previously. The thickness of these extensions is 1 mm.

Figure 7:
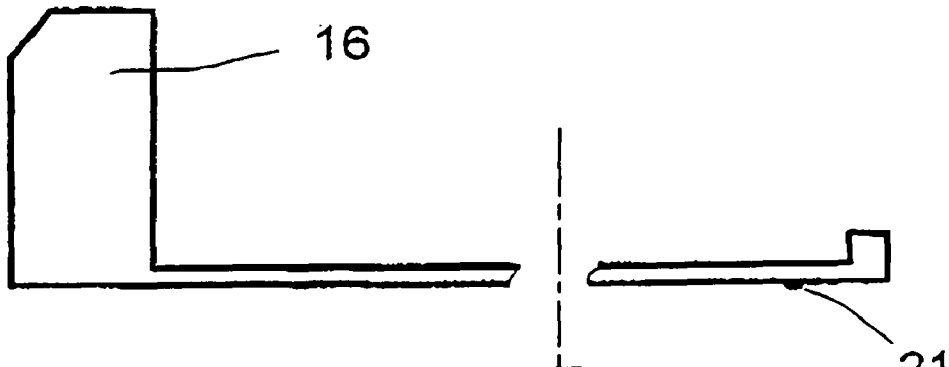
FIG. 7 is a longitudinal sectional view of an example of pull strip intended for moving the back rest manually towards the front of the shelves.

A sliding pull strip 16 as represented on FIG. 7, 370 mm in length, 32 mm in width, and 2 mm in thickness, so as to slide easily above the linking zone 12 and in holding guides 14. The vertical section of the pull strip which touches the rear stop 5 is 10 mm.

Advantageously, the back rest, the rail and the pull strip are low-cost molded transparent plastic parts.

Several variations are possible without departing from the framework of the invention with different shapes and dimensions of back rest and as regards the positioning of the indexed extension pieces, the number of notches as well as the size thereof. The same applies to the toothed counterpart which may be situated differently on the rail and have teeth which are more or less or more or less narrowed.

Obviously, the invention is not limited to the embodiments described and represented by way of example, but it also includes all the technical equivalents as well as the combinations thereof.

I claim:

1. A display rack for receiving edge-standing articles comprising:

a rail suitable for receiving the edge-standing articles, said rail having a surface with wide pleats thereon;

a back rest slidably mounted on said rail, said back rest having a hand-operated pull strip so as to allow said back rest to be positioned in a desired location on said rail, said rail having a pair of rows of wide serrated parallel pleats formed over an entire length of an area over which said back rest is slidable on said rail, a linking zone connecting side portions of said rail, said back rest having a supporting back and a serrated pleated surface suitable for receiving the edge-standing articles and a pair of internal lateral partitions and a lower face, said back rest having a pair of toes positioned on said rail so as to guide said back rest along said track, said back rest having a limit stop positioned in a lower section thereof, said pull strip being positioned under said back rest and above an upper face of said linking zone, said pull strip being retracted and within an area of said rail when not in use, said pull strip bearing on a rear stop of said back rest so as to cause said back rest to slide on said rail; and a backslide-preventing device independent of said wide pleats of said rail, said backslide-preventing device having a pair of indexed extension pieces and a pair of complementary toothed counterparts, said pair of indexed extension pieces being integrally formed with said internal lateral partitions and said lower face of said back rest, each of said pair of indexed extension pieces having several teeth, said pair of complementary toothed counterparts being positioned on lateral extremities of said rail, each of said pair of complementary toothed counterparts having teeth extending over an entire area over which said back rest slides on said rail, said teeth of said indexed extension pieces and said teeth of said complementary toothed counterparts being of a smaller size than a size of said wide plates, said rail and said back rest and said pull strip being formed of a polymeric material.

2. The display rack of claim 1, further comprising:

a semi-automatic returning means for allowing an operator to move said back rest backwards by said pull strip, said semi-automatic returning means comprising a front stop positioned on said rail so as to cause said back rest to tip into position of disengagement when said pull strip is pulled forward, said indexed extension pieces disengaging from said complementary toothed counterparts in said position of disengagement, said pull strip extending from said back rest when said back rest is tipped; and a back stop positioned on said rail so as to cause a tipping of said back rest from said position of disengagement to a normal use position at the end of travel of said back rest on said rail, said indexed extension pieces engaging said complementary toothed counterparts in said normal use position.

* * * * *